United States Patent [19]

Becker

[11] Patent Number: 4,594,059

[45] Date of Patent: Jun. 10, 1986

[54] DIAPHRAGM PUMP

[76] Inventor: Erich Becker, Gloecklehofweg 13, D-7812 Bad Krozingen, Fed. Rep. of Germany

[21] Appl. No.: 716,602

[22] Filed: Mar. 27, 1985

Related U.S. Application Data

[63] Continuation of Ser. No. 442,448, Nov. 17, 1982, abandoned.

[30] Foreign Application Priority Data

Nov. 28, 1981 [DE] Fed. Rep. of Germany ..... 3147218
Mar. 19, 1982 [DE] Fed. Rep. of Germany ..... 3210110
Jul. 8, 1982 [DE] Fed. Rep. of Germany ..... 3229528

[51] Int. Cl.[4] ..... F04B 11/00; F04B 39/08
[52] U.S. Cl. ..... 417/439; 417/540
[58] Field of Search ..... 417/540, 542, 413, 439

[56] References Cited

U.S. PATENT DOCUMENTS 2,143,391 1/1939 Szekely ..... 417/413
2,811,929 11/1957 Rupp ..... 417/540
3,941,519 3/1976 McCauley ..... 417/542
3,947,156 3/1976 Becker ..... 417/413
4,086,036 4/1978 Hagen et al. ..... 417/413

FOREIGN PATENT DOCUMENTS 1428007 12/1968 Fed. Rep. of Germany .
2339811 2/1975 Fed. Rep. of Germany ..... 417/413
2906174 4/1980 Fed. Rep. of Germany .
990042 9/1951 France .
650060 2/1951 United Kingdom .
1232271 5/1971 United Kingdom .
1474326 5/1977 United Kingdom .

*Primary Examiner*—Cornelius J. Husar
*Assistant Examiner*—Peter M. Cuomo
*Attorney, Agent, or Firm*—Peter K. Kontler

[57] ABSTRACT

A diaphragm pump for fluids has a housing, a fluid displacement part including a displacement chamber and a pump diaphragm, and a flow control including a damping chamber arranged to absorb pressure impacts a fluid in aspiration region and having an adjustable fluid admission volume so as to change a fluid supply to the pump diaphragm.

38 Claims, 5 Drawing Figures

21
1a
25
20
18
19
9
16
24
22
28
Pf1
17
D1
22
13
15
10
5
14
27
13
11
12
31
26
8
8
7
6
100
D2
V2
3a
3a
41
4
23
40
39
35
36
33
37
42
38
32

1a
21
25
19
9
16
20
18
24
28
Pf1
13
15
17
5
14
22
11
12
31
8
8
7
6
4
23
V1
3a
3a
41
40
39
35
36
33
37
42
38
32

1b
21
25
20
18
19
9
16
24
50
Pf2
13b
49
48
45
10b
15
5
14
47
46
12
8
8
7
6
4
23
3
3
39
35
36
37
42
38
32

DIAPHRAGM PUMP

This application is a continuation of application Ser. No. 442,448 filed Nov. 17, 1982, now abandoned.

BACKGROUND OF THE INVENTION

The present invention relates to a diaphragm pump for supplying fluid with a flow quantity control.

Diaphragm pumps are known in which the displacement or flow quantity can be controlled in such a manner that, for example, in a pump provided with crank drive the stroke of the displacement element can be changed. This construction, however, requires mechanical expenditures, is susceptible to failures and also is expensive. Other mechanical solutions for this purpose include, for example, a mechanical stepless control of the number of revolutions, or an electrical or electronic control of the number of revolutions of pump. These constructions are also complicated and expensive.

SUMMARY OF THE INVENTION

Accordingly, it is an object of the present invention to provide a diaphragm pump which avoids the disadvantages of the prior art.

More particularly, it is an object of the present invention to provide a diaphragm pump which, without utilization of previously known expensive control devices, can provide for change of flow quantity or displacement quantity of fluid in a simple manner.

In keeping with these objects and with others which will become apparent hereinafter, one feature of the present invention resides, briefly stated, in a diaphragm pump which has a damping chamber arranged to absorb pressure impacts of a fluid in aspiration region and having an adjustable fluid admission volume so as to change a fluid supply to the pump diaphragm.

Pumps with a damping chamber are already known. However, these damping chambers are provided exclusively for smoothing of aspiration and displacement of fluid in a pulsation free manner. In contrast to these solutions, the inventive diaphragm pump has a damping chamber arranged so that its admission volume or flow cross-section are adjustable so as to control the displacement quantity of the pump in a simple manner. The thus-designed damping chamber can serve for damping pulsations of the inflowing medium and at the same time serves for increasing the displacement quantity. Thereby the efficiency of the damping chamber can be deliberately changed and in some cases reduced to zero, so that to control the displacement quantity in accordance with flow techniques.

In accordance with another advantageous feature of the present invention, the admission volume of the damping chamber is limited by a displaceable damping diaphragm. The damping chamber in the region of this diaphragm can be elastically yieldable for compensation of pressure impacts, on the one hand, and the inner volume of the damping chamber can be changed for flow control by respective outside pressure action, on the other hand.

Still another advantageous feature of the present invention is that the rear side pressure action upon the damping diaphragm is performed by a relatively displaceable piston or other displacing element. In dependence upon the position of the above-mentioned piston, different admission volumes of the damping chamber can be obtained.

The diaphragm pump in accordance with the invention serves for displacement of fluid. With the above-described possibility to control the displacement quantity, different displacement volumes per stroke can be obtained in the displacement chamber of the pump. The pump diaphragm adapts automatically to these different displacement volumes. For providing a maximum grade control region without causing damaging actions such as cavitation, a further feature of the present invention is that the region of the differing stroke volumes of the diaphragm pump and the control region of the damping chamber are determined upon one another. This means that the value of the action of the variability of the damping chamber on the flow quantity of the diaphragm pump is brought in correspondence with the value of the volume per stroke which the pump diaphragm can provide. For example, by turning off the action of the damping chamber the flow quantity can be decreased only to such extent that with this minimum flow quantity in the displacement chamber no damaging lower pressure can be generated.

In accordance with still a further advantageous feature of the present invention, the above-mentioned results can be achieved by provision of the elastically deformable region of the pump diaphragm with the respectively great dimensions. The pump diaphragm thereby assumes a shape which corresponds to the minimum displacement quantity of a pump stroke.

Particularly for pumps having small dimensions, it is advantageous in accordance with a further feature of the present invention to form the pump diaphragm as a shaped diaphragm which in its central region at a side facing toward the displacement chamber is mounted on a piston rod in a clamp-free manner. Advantageously, the shaped diaphragm is mounted with the aid of vulcanized-in connecting piece. In this construction a mounting plate which is conventionally provided in the pump diaphragm at its side facing toward the displacing chamber, can be dispensed with. The advantage of this solution is that the pump diaphragm does not have at its side facing toward the displacement chamber metal parts such as screws which extend in the displacement medium unprotected or protected with difficulties. The thus-designed pump diaphragm does not possess the disadvantages of conventional pump diaphragms in which a great central region is clamped between a piston rod and a mounting plate, and only small elastically deformable region remains for adopting to volume conditions for different displacement volumes per working stroke to displace the respective fluid quantities. In the conventionally designed pump diaphragms with the above-mentioned small elastically deformable region cavitation can take place.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
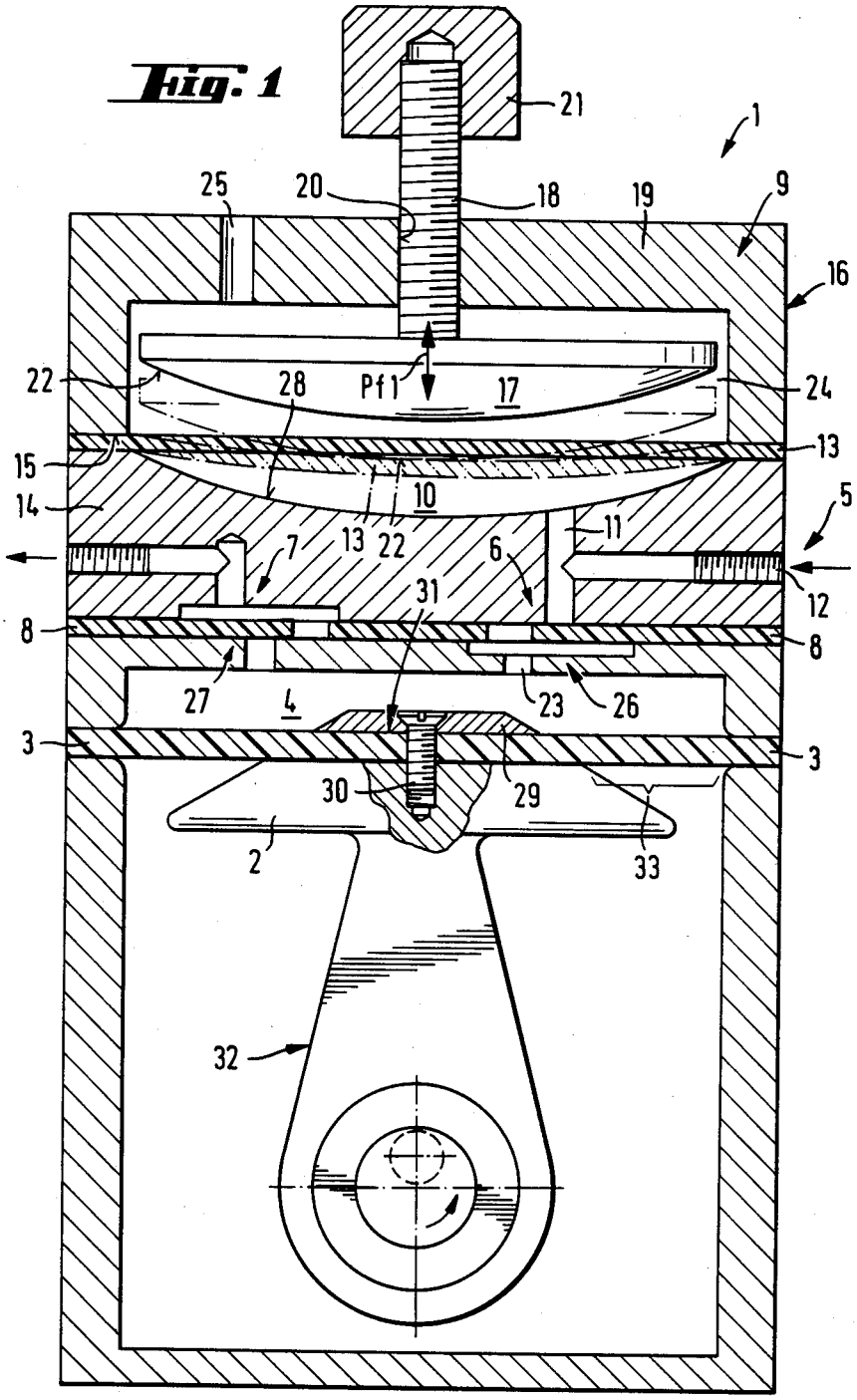
FIG. 1 is a side view showing a section of a diaphragm pump in accordance with the present invention.

A diaphragm pump shown in FIG. 1 is identified with reference numeral 1 and has a pump diaphragm 3 which is connected with a head 2 of a piston rod. A displacement or pumping chamber 4 is located above the pump diaphragm 3 and is bounded by a cylinder head 5. The cylinder head 5 has an inlet valve 6 and an outlet valve 7. A valve plate 8 serves as a closing element for the valves 6 and 7 and has tongue valves 26 and 27 of conventional type.

A damping or oscillating chamber 10 embodying distinctive features of the invention is provided above the cylinder head 5 inside a pump head 9. The damping chamber 10 communicates via a T-shaped connecting conduit 11 with an inlet pipe 12 and the outlet valve 6. The damping chamber 10 is limited at its one side by a damping diaphragm 13, whereas the other limit is formed by the cylinder head 5 and more particularly by a head plate 14 belonging to the cylinder head 5. The damping diaphragm 13 is clamped between the outer edge of the head plate 14 and an end edge 15 of a cup-shaped closing part 16.

Figure 3:
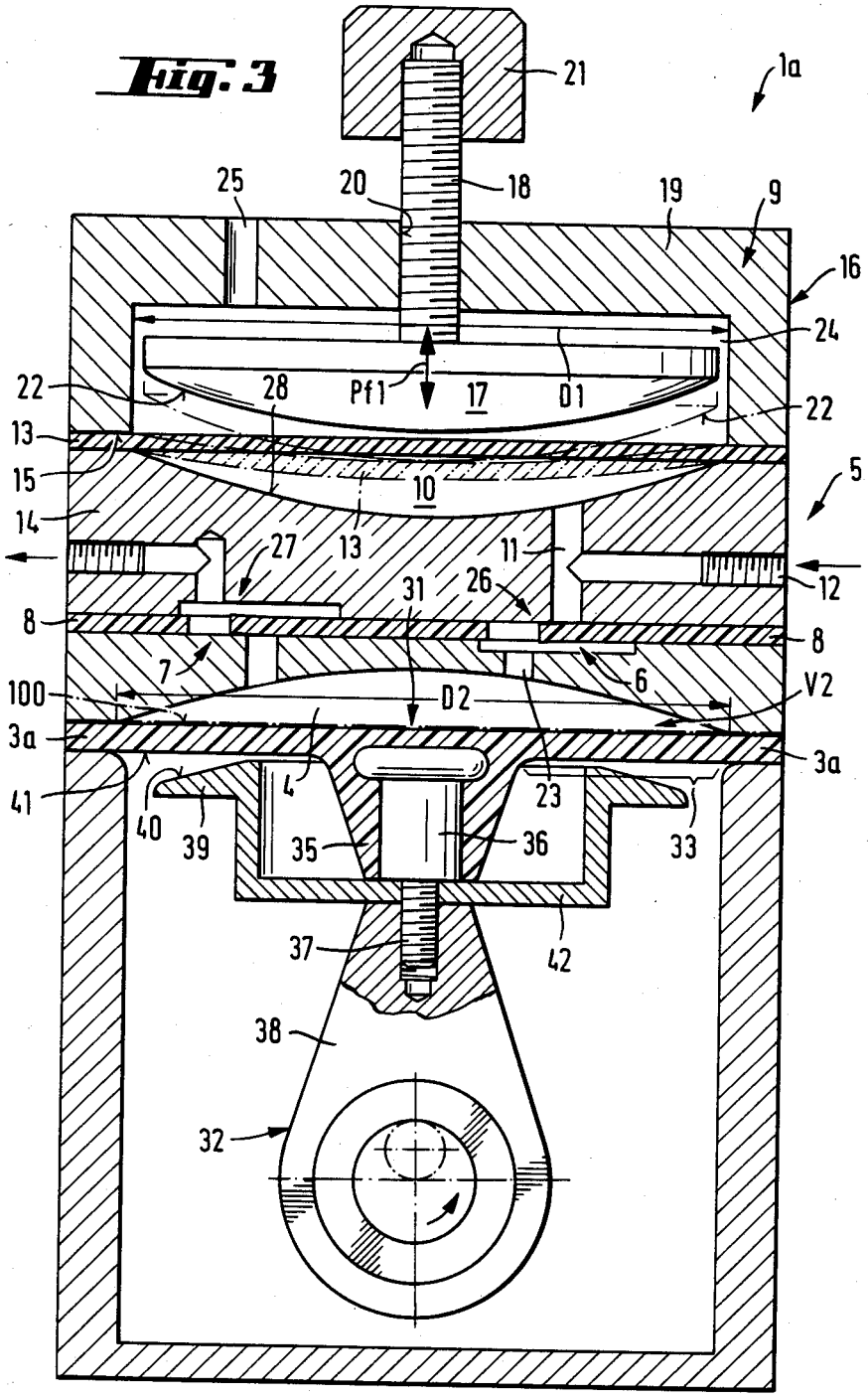
FIG. 3 is a view substantially corresponding to the view of FIG. 1, but showing the diaphragm pump in accordance with another embodiment of the invention.
Figure 4:
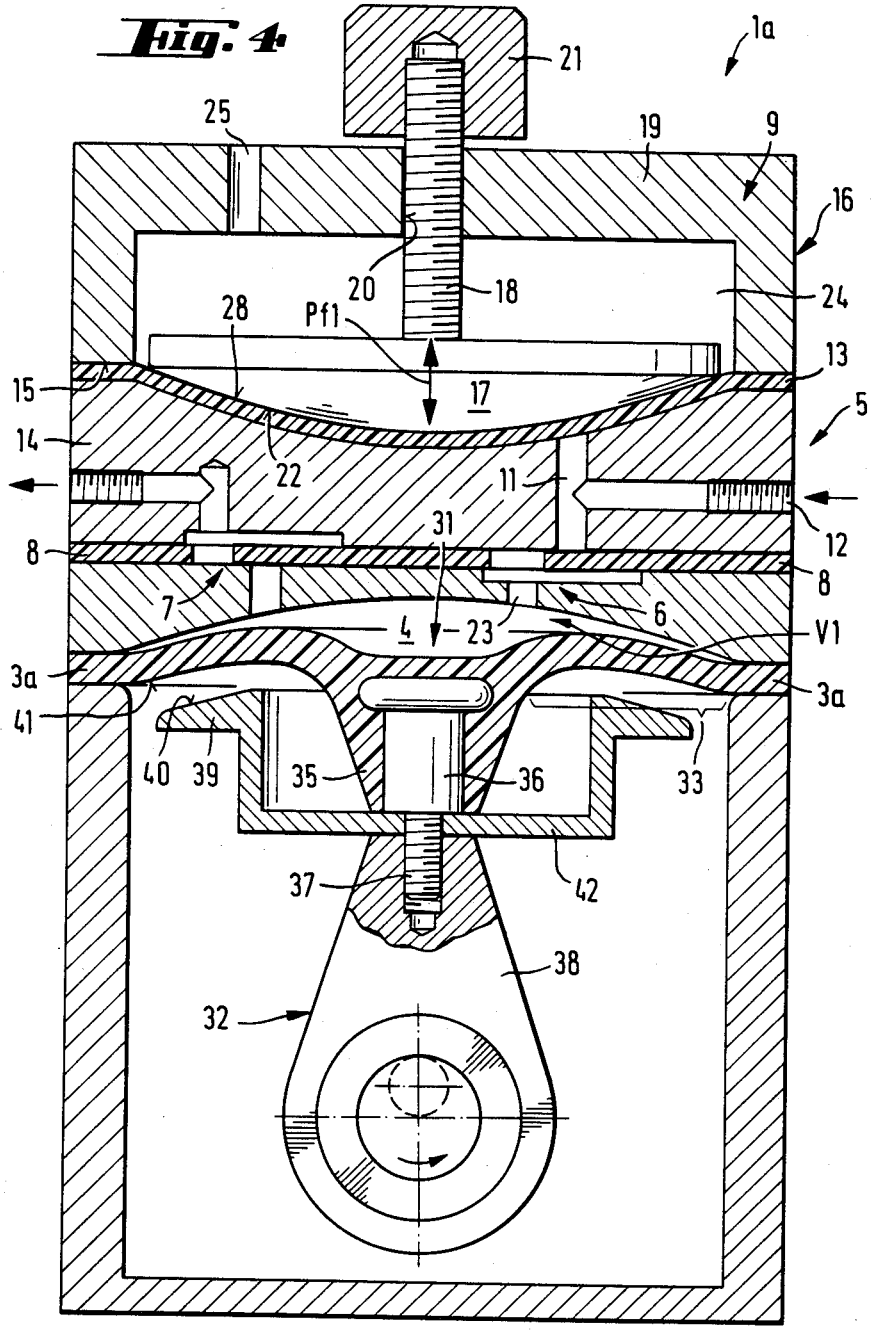
FIG. 4 is a view showing the diaphragm pump of FIG. 3 in a different position for controlling a flow quantity.

In the embodiments shown in FIGS. 1, 3 and 4 the head plate 14 has a surface 28 which faces toward the damping chamber 10 and is concave so that the damping chamber 10 in the case of a round cylinder head has the shape of a spherical segment. A piston 17 or another movable element is arranged inside the closing part 16 and moves relative to the damping diaphragm 13 for providing rear-side pressure loading or displacing the diaphragm 13. The piston 17 has a substantially mushroom-like contour and is provided with a central threaded pin 18 which is screwed in a threaded opening 20 provided in a bottom part 19 of the closing member 16. The piston 17 is displaceable in its axial direction identified by double arrow Pf1 with the aid of an adjusting button 21 provided on the outer end of the threaded pin 18.

Figure 5:
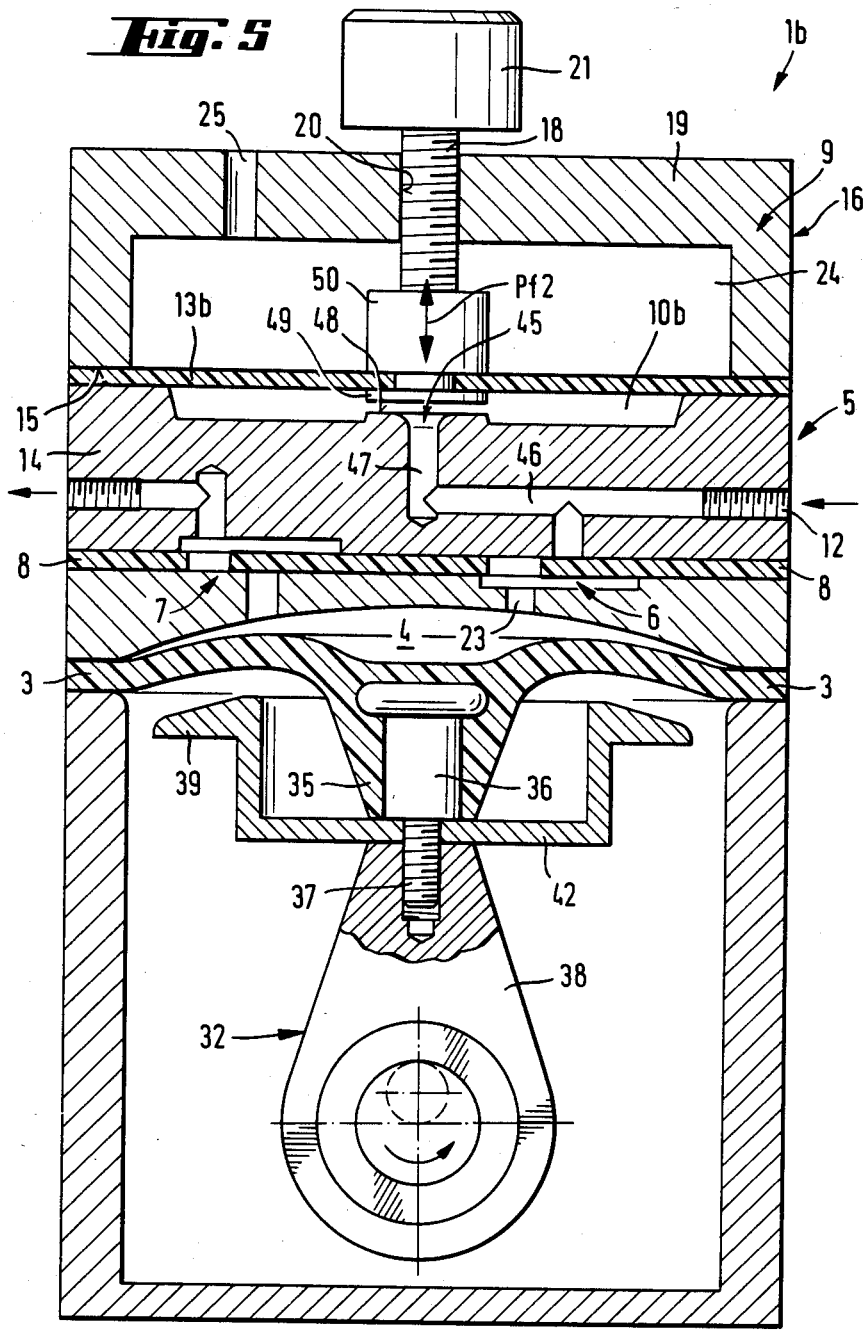
FIG. 5 is a view substantially corresponding to the view of FIGS. 1 and 3, but showing a further embodiment of the inventive diaphragm pump.

The piston 17 has a surface 22 which faces toward the damping diaphragm 13 and has a shape corresponding to the shape of the opposite surface 28 of the head plate. Therefore, the damping chamber 10 can be practically reduced to zero, in which case the damping diaphragm 13 lies on the concave surface 28 of the head plate 14 and is firmly held there by the piston 17 as shown in FIG. 4. Instead of the T-shaped connecting conduit 11, a branch line of another type can be provided which connects the inlet pipe with the inlet valve 6, on the one hand, and with the damping chamber 10, on the other hand, as shown in FIG. 5.

The damping diaphragm 13 in the embodiments shown in FIGS. 1, 3 and 4 is composed advantageously of an elastic material, for example rubber, so that the damping chamber 10 can be varied elastically yieldably in correspondence with the pulsating pressure loading from the inlet pipe 12, when it is not fixedly pressed against the concave surface 28 of the head plate 14. The elastically yieldable damping diaphragm can also act to smooth the pulsating inlet stream when it elastically swings, as shown in FIGS. 1 and 3, in communication with the damping chamber 10 and the T-shaped connecting conduit 11. Thereby an improvement of the efficiency of the pump is attained, inasmuch as the kinetic energy of the aspirated fluid is utilized better.

The supply stream produced during aspiration, for example, in the inlet pipe 12 is no longer stopped by closing of the inlet valve 6, but instead is directed in the damping chamber 10 and stored there under the supply pressure until the inlet valve 6 is again opened. Then displacement fluid from the damping chamber 10 and displacement medium from the inlet pipe 12 flow in the compression or displacement chamber 4, so that the latter is filled faster than in the event when the inlet pipe 12 without communication to a damping chamber supplied the fluid directly to the inlet valve 6 or to the displacement chamber 4.

Figure 2:
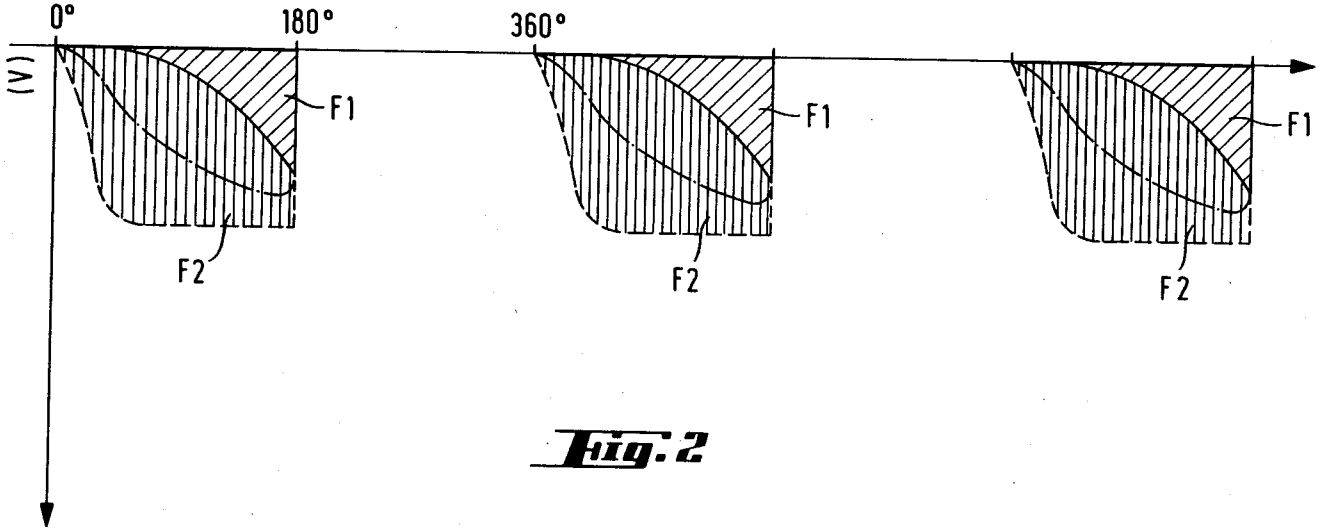
FIG. 2 is a diaphragm showing a flow speed in an aspiration pipe in dependence upon a crank angle, of the inventive diaphragm pump.

FIG. 2 clearly shows the ratio between the respective aspiration and displacement volume with different adjustment of the damping chamber 10. In this diagram the ordinate represents a flow speed V in the inlet opening 23 to the displacement chamber, and the abscisse represents the position of the pump diaphragm 3 via the crank of its crank drive. In zero point of both coordinate axes, the crank drive is in its upper dead point. When the damping chamber 10 is adjusted in its volume by abutting of the damping diaphragm 13 against the concave surface 28 of the head plate 14 and practically provides no action as shown in FIG. 4, the course of curve shown in solid lines in FIG. 2 takes place. It can be clearly recognized that during an initial region of the stroke movement of the pump diaphragm 3, only an insignificant inflow of the displacement fluid in the displacement chamber 4 takes place. As known for the pump expert, the fluid standing in the inlet region must be first driven in movement by the stroke movement of the pump diaphragm 3. Correspondingly, it can be clearly recognized from FIG. 2 that over an initial region of the stroke movement of the diaphragm 3, first only an insignificant flow of the fluid in the displacement chamber 4 takes place. The flow speed increases then gradually until approximately in the lower dead point shown in FIGS. 1, 3 and 4 it goes again to zero by closing of the inlet valve 6. The area F1 between the abscisse and the solid line represents the aspiration volume V1 of the diaphragm pump 1 when it operates practically without the diaphragm chamber 10. This corresponds to the working mode in the event of closed throughflow cross-section 45 in FIG. 5.

When the damping chamber 10 is determined optimally in accordance with the inflow condition, the course of curve shown in broken line in FIG. 2 substantially takes place. It can be seen that in the beginning of the aspiration step a fast increasing supply flow of the fluid takes place, so that in the region available for aspiration between the upper dead point and the lower dead point a considerably greater aspiration volume V2 shown in FIG. 3 is available. With this adjustment a total aspiration volume per working stroke is produced which is represented by both areas F2 and F1 in FIG. 2. It is especially advantageous in the inventive diaphragm pump that in addition to the pulsation damping in a simple manner by changing the damping chamber 10 (FIGS. 1, 3 and 4) or its throughflow cross-section 45 (FIG. 5) also an adjustment of the displaced quantity with the same number of revolutions or number of strokes of the diaphragm pump 1, 1*a*, and 1*b* is achieved. An intermediate position is shown in FIG. 2 in dash-dot lines. The respective intermediate position of the damping diaphragm 13 in FIG. 1 is also shown in dash-dot lines.

The rear partial loading of the damping diaphragm 13 must not necessarily be produced mechanically by the plunger 17 as shown in the described embodiment. It can also be produced by a gas pressure cushion. For example, the inner chamber 24 of the closing part 16 is open outwardly via an opening 25, so that a rear side of the damping diaphragm 13 is acted by atmospheric pressure. In some cases, this opening 25 can be closed and the inner chamber 24 can be loaded with different pressures.

In dependence upon the utilization of the pump 1 and in dependence upon the requirement made to the damping and adjusting properties of the damping chamber 10, the damping diaphragm 13 can be composed of different materials. Especially in the event of a gaseous fluid, a preferable embodiment is when the diaphragm is composed of polytetrafluoro ethylene which is flexible, chemically neutral, considerably temperature resistant and has a mechanical stability. There is also a possibility to produce the damping diaphragm 3 of metal, which can be advantageous, for example in the event of high temperatures and/or working pressures or supply pressures because of its high strength. The utilization of the damping diaphragm 3 of rubber, synthetic plastic material or other elastic material has the advantage of a relatively great adjustment amplitude and a fast response of the damping diaphragm. In this case correspondingly a wider adjustment region is provided under the same conditions. With utilization of considerably non-elastic or low elastic materials, expansion formations can be provided in the damping diaphragm 13, for example formed as wave-like formations arranged concentrically around its center to improve its resiliency.

When a diaphragm pump is provided with a controllable damping chamber 10, a diaphragm pump 1 shown in FIGS. 1 and 3 is obtained which is controllable relative to its displacement volume per second by the adjustability of the damping chamber 10 without the need of changing the stroke height of the piston rod or its rotary speed. Since the pump diaphragm 3 has its inherent flexibility, it can be adapted in predetermined limits to different aspiration volumes.

In accordance with a further embodiment of the invention, the control region of the diaphragm pump 1 can be increased, or it can be taken care that inside the operative control region undesirable operation phenomena, for example cavitation are reliably excluded. For this purpose, the region of different suction volumes, on the one hand, and the control region of the damping chamber 10, on the other hand, can be determined upon one another. Also, various methods can be taken which are shown in FIGS. 3 and 4 for a diaphragm pump 1*a*.

The piston rod 32 of the diaphragm pump 1*a* must be located in the lower dead point. Simultaneously, the damping diaphragm 13 must have a certain swinging freedom corresponding to the shown position of the piston 17, and with this adjustment the compression chamber 4 must obtain an optimum filling with the suction volume V2 per each stroke. The diaphragm pump 1*a* operates then with the maximum flow quantity per time unit, which corresponds to the combined areas Fl and F2 of FIG. 2. When it is desired to reduce the flow quantity per time unit, for example for minimum controllable flow quantity per second, the piston 17 is displaced to a position shown in FIG. 4. Thereby the function of the damping chamber 10 is practically terminated. The pump works when considerably smaller suction volume V1 per pump stroke as shown in FIG. 4.

A comparison of a shaped diaphragm 3*a* in FIGS. 3 and 4 shows that the pump diaphragm with its elastic region 33 adopt to the smaller suction volume V1 in accordance with FIG. 4. Since all pump diaphragms of diaphragm pumps have an elastic and/or flexible region 33, a certain adaptation to the respective suction volume per stroke is inherently provided in the diaphragm pump. In dependence upon the design of the diaphragm pump 1 and its diaphragm chamber 10 and upon the flow condition during flowing of the displacement medium into the displacement chamber 4, in the event of reduction of the flow quantity such an operational condition can be attained in which the suction volume V1 in FIG. 4 is so small that the elastically deformable region 33 of the diaphragm 3 or 3*a* can no longer be adjusted to this suction volume V1. By its diaphragm movement, this diaphragm 3 provides more pump chamber than the aspirated fluid is available. The membrane pump has then a tendency to generate a negative pressure which can cause cavitation phenomenon. For preventing this, the aspiration volume and the control region of the damping chamber 10 are determined upon one another. In particular, it can be provided that the elastically deformable region 33 of the pump diaphragm 3 has correspondingly great dimensions. This is carried out, for example, so that the pump diaphragm is formed as the shaped diaphragm 3*a* with relatively great elastically deformable region 33. This also can be achieved in the same condition when the shaped diaphragm 3*a* in its central region 31 at the side of the displacement chamber 4 is mounted on the connecting rod in a clamp-free manner.

In the embodiment shown in FIGS. 3 and 4 this is achieved in that the shaped membrane 3*a* in its central region has a connecting part 35 facing toward the connecting rod 32, and a metallic mounting piece 36 is vulcanized in this connecting part. The mounting piece 36 has a mounting pin 37 through which it is connected with a shaft 38 of the connecting rod. As a result of this, not only the diaphragm side facing toward the displacement chamber 4 is free from metallic mounting parts, which in some cases provided with a chemically resistant layer 100 shown in dash-dot lines in FIG. 3, but also this prevents that a mounting plate 29 connected by a screw 30 with the connecting rod head 2 shown in FIG. 1 renders a great part of the central region 31 of the membrane nondeformable and makes the elastically deformable region of the pump diaphragm very small, under the same condition.

A further advantageous embodiment is provided when a supporting ring 39 is mounted on the connecting rod 32. The supporting ring 39 is arranged with its ring-shaped supporting surface 40 in a central zone of the elastically deformable region 33 of the pump diaphragm 3 or 3*a*. In normal conditions it does not contact the diaphragm pump 3 in its outer surface 41 facing toward the connecting rod. However, this outer surface 41 can be supported when necessary, so that the pump diaphragm 3 cannot "turn over", or in other words bulge downwardly. It is thereby guaranteed that the diaphragm 3 assumes in the vicinity of the displacement chamber 4 at least a substantially flat shape as shown in FIG. 3 or a convex shape toward the displacement chamber 4 as shown in FIG. 4. An instability of the diaphragm 3 which is unfavorable for the aspiration volumes V1 or V2 is avoided.

As can be clearly seen from FIGS. 3 and 4, the supporting ring 39 is connected via a cup-shaped or basket-shaped lower part 42 with the shaft 38 of the connecting rod. Advantageously, the mounting piece 36 with its mounting pin 37 can be used for this purpose. As can be seen from FIG. 3, the diameter D1 of the damping chamber 10 substantially corresponds to the diameter D2 of the displacement chamber 4. Experiments have shown that with such a design of the displacement chamber it can be easily carried out structurally, flow conditions in the region of the inlet pipe 12, the inlet valve 6 and the damping chamber 10 are such that a good control possibility for the flow quantity of the diaphragm pump 1 and 1*a* per time unit is obtained.

FIG. 5 shows a further somewhat different embodiment of the diaphragm pump 1*b*. In the above-described embodiments of the diaphragm pump 1 and 1*a* in accordance with FIGS. 1, 3 and 4 the respective volume quantitites which are received by the damping chamber 10 in each aspiration step depend upon the position of the piston 17 in connection with the elastic deflectability of the damping diaphragm 13. In accordance with the embodiment of FIG. 5, the volume of the displacement medium aspirated during each aspiration stroke and flowing in a damping chamber 10*b* is changed by a controllable throughflow cross-section 45. A two-end branch conduit 46 leading from the inlet pipe 12 to the inlet valve 6, on the one hand, and to the damping chamber 10*b*, on the other hand, is formed so that its end portion 47 which leads to the damping chamber 10*b* ends centrally in a closing surface 48 located, advantageously centrally, in the damping chamber 10*b*. The closing surface 48 cooperates with a displaceable closing element 49 which is a part of a displacing element 50 connected with the adjustment button 21. The displacing element 50 extends through a diaphragm 13*b*, as well as clamps it there tightly and hold it firmly. A valve plate-like closing element 49 which belongs to the displacement element 50 is located at that side of the damping diaphragm 13*b* which faces toward the damping chamber 10*b*. By rotation of the adjustment button 21, the closing element 49 can move toward or away from the closing surface 48 in direction of the arrow Pf2 in FIG. 5. Correspondingly, the throughflow cross-section 45 which is available for the pulsating displacement medium in the end portion 47 of the branch conduit 46, is changed. The above-described effect of the variable extension chamber principle in connection with FIGS. 1-4 which leads to increase or reduction of the supply flow of the displacement medium at the inlet valve 6, is achieved in the embodiment of the diaphragm pump 1*b* of FIG. 5 particularly with cooperation of low technical features, namely by closing or more or less opening of the throughflow cross-section 45.

This solution has several advantages. For fully covering the control region of the diaphragm pump 1*b*, it is required to deflect the damping diaphragm 13*b* by only relatively small amounts. When the damping diaphragm 13*b* is composed, for example, of polytetrafluoro ethylene or the like chemically inert material which is desirable in the most cases, there is the advantage that great deflection for covering the control region of the diaphragm pump 1*b* is not required. In correspondence with this, there is not an undesirable great loading, particularly expansion of such material as for example polytetrafluoroethylene which is considerably flexible, but a little elastically expandable and in the event of respective loading has a tendency to cold flowing. Unfavorable expansion loads which can be recognized for example by comparison of the damping diaphragm 13 in FIGS. 3 and 4 can be avoided in the embodiment of FIG. 5.

In the closed position which is not shown in FIG. 5, in which the closing element 49 abuts against the closing surface 48, there is a condition which is described in connection with FIG. 4 for the diaphragm pump 1*a*. The described embodiment of FIG. 2 is applicable for the embodiment of FIG. 5. With the damping chamber 10*b* of FIG. 5, the change of the volume of the damping chamber 10*b* proper or first of all the actual change of the volume admission by the control of the flow cross-section 45 does not matter or matters only unimportantly. What is common for the embodiments of the diaphragm pumps 1, 1*a* and 1*b* is that the quantity of the fluid which flows to the damping chamber per aspiration stroke of the pump or flows out of the damping chamber 10 or 10*b* is selectively adjusted and thereby the displacement volume of the diaphragm pumps 1, 1*a* and 1*b* can be controlled.

The inventive design of the diaphragm pumps 1, 1*a* and 1*b* with the damping chamber 10 is applicable advantageously for small or smallest pumps with a displacement efficiency of advantageously approximately 0.2 liter per minute—20 liter per minute. With very simple not flow susceptible means, the diaphragm pump is provided with a built-in flow quantity control corresponding to flow techniques, and the operation of the diaphragm pump is considerably improved in the working region. The diaphragm pump 1 is particularly usable because of the damping chamber 10 in a through flow quantity region which is located above the standard displacement quantity of these pumps. The term "standard displacement quantity" is used here to identify the diaphragm pumps without the damping chamber. It is possible to have a relatively small and respectively inexpensive pump whose displacement quantity per time unit can be increased in a simply controllable manner by addition of the adjustable damping chamber.

It is to be understood that the diaphraqm pump 1 with its pump diaphragm 3 is designed so that with the damping chamber 10 adjusted to zero can operate in disturbance-free manner and without cavitation.

It will be understood that each of the elements described above, or two or more together, may also find a useful application in other types of constructions differing from the types described above.

While the invention has been illustrated and described as embodied in a diaphragm pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims.

What is claimed is:

1. A diaphragm pump for liquids, comprising a housing having a pumping chamber; a pump diaphragm adjacent said chamber and having a central region; a supporting member for the central region of said pump diaphragm; a piston connected with said diaphragm and arranged to perform alternating aspiration and exhaust strokes to thereby draw liquid into and expel liquid from said chamber, said diaphragm having an elastically deformable portion the extent of deformation of which is a function of the quantity of liquid in said chamber; means for moving said piston to thereby displace said piston and vary the volume of said chamber; flow control means having a variable-volume oscillating chamber arranged to absorb pressure impacts of the liquid during aspiration strokes of said piston and to receive at least during the last stage of each aspiration stroke that liquid which can no longer enter said pumping chamber as well as to admit at least during the initial stage of each aspiration stroke into the pumping chamber liquid which has entered the oscillating chamber during the preceding aspiration stroke; liquid admitting means including an inlet opening provided in said housing and communicating with said chambers during the aspiration strokes of said piston; a flexible diaphragm adjacent said oscillating chamber; and means for adjusting the position of said flexible diaphragm and for simultaneously adjusting the effective volume of said oscillating chamber.

2. A diaphragm pump as defined in claim 1, wherein said housing has a pump head defining said oscillating chamber and said liquid admitting means comprises a conduit connecting said chambers.

3. A diaphragm pump as defined in claim 2, wherein said conduit is a T-shaped conduit.

4. A diaphragm pump as defined in claim 2, further comprising an inlet valve, said conduit being connected with said pumping chamber by way of said inlet valve.

5. A diaphragm spring as defined in claim 1, wherein said flexible diaphragm has a surface facing away from said damping chamber and said adjusting means includes means for subjecting said flexible diaphragm to the action of different loads while the pump is in use.

6. A diaphragm pump as defined in claim 5, wherein said subjecting means includes means for applying gas pressure to said surface of said flexible diaphragm.

7. A diaphragm pump as defined in claim 6, wherein said surface of said damping diaphragm is acted upon by, atmospheric pressure.

8. A diaphragm pump as defined in claim 5, wherein said subjecting means includes a displacing member movable relative to and arranged to act upon said surface of the flexible diaphragm.

9. A diaphragm pump as defined in claim 8, wherein said displacing member includes piston.

10. A diaphragm pump as defined in claim 1, wherein said housing has a head plate covering said pumping chamber and said oscillating chamber is disposed between said head plate and said flexible diaphragm.

11. A diaphragm pump as defined in claim 10, wherein said housing further includes a cup-shaped closing part, said flexible diaphragm having a marginal portion clamped between said head plate and said cup-shaped closing part.

12. A diaphragm pump as defined in claim 8, wherein said housing has a cup-shaped closing part and said displacing member is mounted in said closing part.

13. A diaphragm pump as defined in claim 12, wherein said housing also has a head plate with a surface facing toward said displacing member, said displacing member having a surface which faces toward said flexible diaphragm and has a shape corresponding to that of said surface of said head plate.

14. A diaphragm pump as defined in claim 8, wherein said displacing member is mushroom-shaped and has a central threaded pin.

15. A diaphragm pump as defined in claim 14, wherein said housing further includes a closing part with a bottom having a threaded opening, said threaded pin of said displacing member being screwed into said threaded opening so that said mushroom-shaped displacing member is axially displaceable.

16. A diaphragm pump as defined in claim 1, wherein said flexible diaphragm contains an elastic material.

17. A diaphragm pump as defined in claim 16, wherein said flexible diaphragm consists of rubber.

18. A diaphragm pump as defined in claim 1, wherein said flexible diaphragm consists of polytetrafluoroethylene.

19. A diaphragm pump as defined in claim 1, wherein said flexible diaphragm consists of metal.

20. A diaphragm pump as defined in claim 1, wherein said flexible diaphragm has a low elasticity.

21. A diaphragm pump as defined in claim 1, wherein said flexible diaphragm has a center and said elastically deformable portion includes at least one wave-like profile provided on said flexible diaphragm at least substantially concentrically around its center.

22. A diaphragm pump as defined in claim 1, wherein the displacement of said pump is between substantially 0.2 and 20 liters per minute.

23. A diaphragm pump as defined in claim 1, wherein said pumping chamber has variable aspiration volumes and said osciallating chamber has a control region related to one another.

24. A diaphragm pump as defined in claim 1, wherein said pumping chamber has a relatively wide range of different stroke volumes.

25. A diaphragm pump as defined in claim 24, wherein said pump diaphragm has an elastically deformable region which extends over a relatively large part of its area so as to provide said relatively wide range of different stroke volumes.

26. A diaphragm pump as defined in claim 1, wherein said pump diaphragm has a central region and said piston has a piston rod, the central region of said pump diaphragm being affixed to said piston so that its side facing away from said pumping chamber is movable relative to said piston rod.

27. A diaphragm pump as defined in claim 26, further comprising a mounting piece vulcanized said pump diaphragm in said central region thereof and securing said pump diaphragm to said piston.

28. A diaphragm pump as defined in claim 1, wherein said pump diaphragm has a side facing away from said pumping chamber and said supporting member includes a ring disposed at said side of said pump diaphragm.

29. A diaphragm pump as defined in claim 1, wherein said piston has a piston rod and said supporting member is connected with said piston rod.

30. A diaphragm pump as defined in claim 29, wherein said supporting member is cup-shaped.

31. A diaphragm pump as defined in claim 29, wherein said supporting member is basket-shaped.

32. A diaphragm pump as defined in claim 29, wherein said pump diaphragm has a mounting piece connecting said supporting member with said piston rod.

33. A diaphragm pump as defined in claim 1, wherein said chambers are circular and have substantially identical inner diameters.

34. A diaphragm pump as defined in claim 1, wherein said adjusting means includes means for changing the rate of liquid flow to said oscillating chamber so as to change the volume of admitted liquid in said oscillating chamber.

35. A diaphragm spring as defined in claim 34, wherein said means for changing the rate of liquid flow has a branch conduit having a portion which communicates with said oscillating chamber, a displaceable element movable relative to said portion of said branch conduit, and an adjusting member operable to displace said displaceable element with reference to said portion of said branch conduit.

36. A diaphragm pump as defined in claim 35, wherein said displaceable element extends through and is connected to said flexible diaphragm.

37. A diaphragm pump as defined in claim 36, wherein said flexible diaphragm has a central region and said displaceable element extends through and is affixed to said central region.

38. A diaphragm pump as defined in claim 35, wherein said displaceable element has a portion which faces toward said oscillating chamber and is movable to a position in which it seals said branch conduit from said oscillating chamber.

* * * * *